US008028648B2

(12) United States Patent
Karusalmi et al.

(10) Patent No.: US 8,028,648 B2
(45) Date of Patent: Oct. 4, 2011

(54) ROD CRADLE, INSTERT TO BE USED IN A ROD CRADLE, AND METHOD FOR INSERTING A ROD IN A ROD CRADLE

(75) Inventors: Arto Karusalmi, Korpilahti (FI); Ari-Pekka Kautto, Jyskä (FI); Sami Kuparinen, Jyväskylä (FI); Vesa Lamberg, Jyväskylä (FI); Pekka Ylönen, Palokka (FI)

(73) Assignee: Metso Paper, Inc., Helsinki (FI)

( * ) Notice: Subject to any disclaimer, the term of this patent is extended or adjusted under 35 U.S.C. 154(b) by 791 days.

(21) Appl. No.: 12/095,705

(22) PCT Filed: Nov. 28, 2006

(86) PCT No.: PCT/FI2006/050523

§ 371 (c)(1),
(2), (4) Date: May 30, 2008

(87) PCT Pub. No.: WO2007/063183

PCT Pub. Date: Jun. 7, 2007

(65) Prior Publication Data

US 2010/0089313 A1 Apr. 15, 2010

(30) Foreign Application Priority Data

Dec. 2, 2005 (FI) ..... 20055643
Oct. 27, 2006 (FI) ..... 20060449 U

(51) Int. Cl.
*B05C 11/04* (2006.01)
*B05D 1/40* (2006.01)

(52) U.S. Cl. ..... 118/110; 118/123; 118/126; 118/262; 118/414; 427/428.14; 427/359

(58) Field of Classification Search ..... 118/110, 118/123, 126, 262, 414; 162/281; 101/120; 15/256.5, 256.51, 256.52; 427/428.14, 359
See application file for complete search history.

(56) References Cited

U.S. PATENT DOCUMENTS 5,101,757 A * 4/1992 Schumacher ..... 118/46
(Continued)

FOREIGN PATENT DOCUMENTS

DE 19626580 A1 1/1998
(Continued)

OTHER PUBLICATIONS

Written Opinion of the International Searching Authority issued in PCT/FI2006/050523.

(Continued)

*Primary Examiner* — Laura Edwards
(74) *Attorney, Agent, or Firm* — Stiennon & Stiennon

(57) ABSTRACT

A rod cradle for a film, coating, or dam rod includes a frame profile (12) equipped with an insert groove (14), an insert (16) fitted into the insert groove, and the insert having a rod groove (18) and a rod (28) therein. The device has locking elements (24) for locking the insert (16) into the frame profile (12). There are, on the sides of the insert groove, edges (20) through which the insert passes into the insert groove when the rod is not present. On the sides of the rod groove (16) there are opposing lips (22). The lips (22) have vertices (74) through which the rod (28) can pass without damage to the rod or the insert so that the rod can be inserted in to the rod groove (18) and lock the insert (16) in the insert groove (14) of the frame profile.

19 Claims, 8 Drawing Sheets

U.S. PATENT DOCUMENTS

| | | | | |
|---|---|---|---|---|
| 5,980,634 | A * | 11/1999 | Tomatis | 118/118 |
| 6,790,280 | B2 * | 9/2004 | Lummila | 118/118 |
| 6,911,085 | B2 | 6/2005 | Knop | |
| 2005/0039676 | A1 | 2/2005 | Knop | |

FOREIGN PATENT DOCUMENTS

| | | | |
|---|---|---|---|
| DE | 10045515 | A1 | 4/2002 |
| EP | 0848110 | A1 | 6/1998 |
| WO | 00/63494 | A1 | 10/2000 |
| WO | 03/078077 | A1 | 9/2003 |
| WO | 2007063183 | A1 | 6/2007 |

OTHER PUBLICATIONS

Search Report issued in PCT/FI2006/050523.

Search Report issued in FI20055643.

The State Intellectual Property Office of the People's Republic of China, The First Office Action for CN101321914, Application No. 200680044992.1, dated May 19, 2010.

* cited by examiner

ROD CRADLE, INSTERT TO BE USED IN A ROD CRADLE, AND METHOD FOR INSERTING A ROD IN A ROD CRADLE

CROSS REFERENCES TO RELATED APPLICATIONS

This application is a U.S. national stage application of International App. No. PCT/FI2006/050523, filed Nov. 28, 2006, the disclosure of which is incorporated by reference herein, and claims priority on Finnish App. Nos. 20055643, filed Dec. 2, 2005, and U20060449, filed Oct. 27, 2006.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to a rod cradle for a film, coating, or dam rod, which rod cradle includes a frame profile equipped with an insert groove, an insert fitted to this equipped with a rod groove and a rod, and locking elements for locking the insert into the frame profile, and on the sides of the insert groove in the frame profile there are edges and on the sides of the rod groove there are opposing lips corresponding to them, and the lips include a vertex, a cover surface, which cover surface is in contact with the rod when the rod is in the rod groove, and a vertex surface, which separates from the cover surface at the vertex. The invention also relates to a corresponding insert and a method.

Rod cradles are used mainly in sizing and coating devices operating on the film-transfer principle and in coating application taking place directly onto the surface of the paper. A rod cradle, in which there is a separate insert, is, as such, known. In such rod cradles, the locking of the insert is implemented by means of a locking hose, as disclosed in publication WO3078077. A rod cradle with an insert is a good solution, as rod cradles must be changed regularly, which leads to spare-parts costs. When the component to be changed is only the wearing part, i.e. the insert, instead of the rod cradle, both cost savings and a reduction in waste material are achieved in device servicing.

When locking the insert using a locking hose, the locking hose must be located in the rod cradle, which is not, however, technically reliable. A drawback when using the locking-hose technique is the uncertainty of the locking, if pressure is lost for some reason, for example, if the hoses leak, or are wrongly connected. In addition, the implementation of the hose locking leads to costs, as a separate groove for the hose must be cast or machined. In addition, the additional grooves in the frame of the rod cradle may cause excessive flexibility in the frame of the rod cradle. The use of a locking hose is also significant in terms of work safety, as, if the locking hose fractures, the force retaining the insert disappears and the rod or the insert can detach, causing a dangerous situation.

The locking of the rod can also be based on using loading means to press the rod cradle towards the surface, on which, for example, coating is being applied. In this embodiment too, the problem is the uncertainty of whether the rod and the insert will remain in the groove, for example, if the loading is momentarily reduced. In addition, problems can arise when application is starting, when the loading means may not yet be pressing towards the application surface with sufficient force to hold the rod in its groove in the rod cradle.

FIG. 1 shows one rod cradle according to the prior art. The rod cradle includes a frame profile 12 equipped with an insert groove 14. An insert 16, equipped with an rod groove 18, and a rod 28 and locking elements 24 are fitted to the frame profile 12. The locking of the insert 16 to the frame profile 12 takes place with the aid of these locking elements 24. At the sides of the insert groove 14 in the frame profile 12, there are edges 20. On the sides of the rod groove 18 there are lips 22 corresponding to them. The lips 22 include a cover surface 72, 72', which is in contact with the rod 28, when the rod 28 is in the rod groove 18, as well as a vertex surface 70, 70', which starts from the cover surface 72 at its extreme vertex of contact with the rod, i.e. at the vertex 74, 74'. In the solution according to the prior art, the rod is first placed in the insert, which is then placed in the frame profile. The locking that takes place using the locking elements can be ensured, for example, using the locking hose described above.

SUMMARY OF THE INVENTION

The invention is intended to create a new type of rod cradle, in which the retention of the insert and the rod in the grooves is ensured better than previously. The invention is also intended to create a new type of insert for use in a rod cradle, which will ensure the retention of the insert and rod better than previously. In addition, the invention is intended to create a new type of method for setting a rod in a rod cradle. The invention includes both a rod-cradle frame and an insert, which is locked to the frame using the rod placed in the rod groove, i.e. the insert is locked when the rod is placed in the rod groove in the insert. When the rod locks the insert in the frame profile, the construction of the rod cradle is simpler and more reliable in operation than previously.

The rod cradle is intended for a film, coating, or dam rod. The rod cradle includes a frame profile equipped with an insert groove, an insert fitted to the frame profile and equipped with a rod groove, and a rod, as well as locking elements. The locking elements are used to lock the insert to the frame profile. In the frame profile, there are edges in the sides of the insert groove while on the sides of the rod groove there are lips corresponding to the edges. The lips include a cover surface, which is in contact with the rod when the rod is in the rod groove, and a vertex surface, which separates from the extreme point of contact of the contact surface. In addition, the said locking elements comprise a locking arrangement between the edges of the insert groove and the lips of the insert, which is arranged to permit the insert to be set in place with the rod groove empty, and to lock each said lip to each edge opposite to it when the rod is in the rod groove.

The locking of the insert in the insert groove can take place using a locking arrangement, which includes a locking tooth at least in the edge of the second insert groove and a corresponding locking detent in the adjacent lip. When locking the insert in place, even a single locking detent will be sufficient to prevent the insert from sliding out of the insert groove, as long as the shape of the opposing side is sufficiently tight. In a preferred application, however, a symmetrical locking construction is used. There can also be several locking teeth and detents.

In one embodiment, the angle $\alpha$ between the tangent of the vertex surface traveling through the vertex and the tangent of the cover surface traveling through the same vertex is 60°-180°, preferably 95°-125°. The vertices of the lips are then shaped in such a way that the rod can be placed between them into the rod groove while the rod and lip retain their desired shape.

In a second embodiment, the tangent of the first vertex surface meets the tangent of the second vertex surface between the vertices directly on the side of the rod groove. In that case, the vertex surfaces are shaped in such a way that the rod can be placed in the rod groove when the insert is in the insert groove. In other words, the vertices in the insert will not be damaged, as long as the vertex surfaces are correctly aligned. The rod will also go into the rod groove without damage.

In a third embodiment, there is a water groove in the insert, the area on the bottom of which forms a neck, which is arranged to act as a hinge. A selected degree of flexibility is required in the insert, so that it can be installed in the insert groove. Part of the flexibility is obtained through the material properties, and part from the construction. In the construction, the area on the bottom of the water groove forms a neck, which is arranged to act as a hinge. When placing the insert in the insert groove, the necessary flexibility takes place at the location of the hinge formed by the neck.

In a fourth embodiment, there is at least one additional groove in the insert, in order to create the selected flexibility. If the flexibility of the bottom of the water groove acting as a hinge is not sufficient together with the material properties, an additional groove, or grooves can be made in the insert, to achieve the selected flexibility. The desired flexibility in the insert is preferably in such a range, that the point load used in installing the insert is 10-500 N.

In a fifth embodiment, the locking arrangement includes locking toothing in the edge of the insert groove and a corresponding locking detent in the adjacent lip. When the insert groove contains two locking teeth and the insert contains two locking detents corresponding to them, a locking arrangement is formed in both sides of the insert. Preferably, when drawing a straight line between these locking arrangements, it travels preferably through the intersection surface of the rod.

In a sixth embodiment, the frame profile is of polyethylene or polyurethane. The material of the rod-cradle frame profile, which is used many times, can be polyethylene, polyurethane, or some other suitable material.

In a seventh embodiment, the insert is polyethylene, which contains additives improving its wear-resistance, or reducing its friction. The insert, in turn, can be manufactured from polyethylene, polyurethane, or some other material suitable for the purpose, in which there are additives to reduce friction, or to improve wear-resistance or machinability. The insert is preferably of polyethylene. The aim is to optimize the aforementioned properties by adding even several additives to the base material, in such a way that as to achieve an optimal combination of the important properties.

In an eighth embodiment, there is a cover area between the vertices on the rod-groove side, which is arranged to cover the rod with a cover angle β, which is 190°-250°, preferably 210°-230°. In addition to the cover angle, the material selection is used to adjust the force required to install the rod in the rod groove. In other words, in addition to the materials, the installation force is affected by the cover angle of the lips. The materials and cover angle of the lips are preferably selected in such a way that the point force required to install the rod in the rod groove is 50-1000 N, when the cover angle is about 220° (more usually 190°-250°).

In a ninth embodiment, the rod cradle includes an insert axial-motion prevention element, which extends on the longitudinal, i.e. axial line of the insert. The axial-motion prevention element prevents the insert from moving in the insert groove in the longitudinal direction of the insert. As the axial-motion prevention element extends radially to the longitudinal line of the insert, movement of the insert is prevented. The axial-motion prevention element can be, for example, a screw, by means of which the insert is attached to the frame profile, or a shaping in the frame profile, which extends radially to the axial line of the insert when the insert is in the insert groove. Of course, a corresponding shaping must be made in the insert, in order that the shaping in the insert groove can lock the insert as desired. In the prior art, the shapes are located in such a way that they are not radially on the longitudinal line of the insert. While the shapes according to the prior art can prevent the insert from jumping out of the insert groove, in the solution according to this embodiment the shapes prevent precisely the axial motion of the insert.

In a tenth embodiment, the axial-motion prevention element is such that the detaching of the insert from the prevention element can be performed without tools. An axial-motion prevention element of this type can be, for example, the shaping in the insert groove described above. As tools are not required to detach the prevention element, replacing the insert with a new one is extremely easy. In that case, the only tool required for changing the insert can be one, by means of which the insert can be popped out of the groove. The insert can be quickly popped out of the groove, for example, by levering it with a flat-headed screwdriver. If the axial-motion prevention element, for example a screw, needs to be detached by screwing, the replacement of the insert will take considerably longer.

In an eleventh embodiment, the axial-motion prevention element is at least in connection with one end of the rod cradle. When the axial-motion prevention element is in connection with the end of the rod cradle, the frame profile is easier to manufacture than when the prevention element is in the center of the frame profile. Manufacture is easier, as in that case the frame profile can be made, for example, by casting, or by machining it to be the same over its entire width. The axial-motion prevention can be, for example, an end flange. The end flange can be cast directly onto the end of the insert, but it is preferably made separately and attached to the insert. The attachment can take place, for example, using screws.

In a twelfth embodiment, the axial-motion prevention element is attached to the frame profile. When attaching the prevention element to the frame profile, larger screws are used than when attaching the prevention element to the insert, so that the totality is made more durable than when attaching the prevention element to the insert. In addition, attachment to the insert may induce stresses in the insert. Similar stresses in the frame profile will not be as detrimental, as the frame profile has a more massive construction. In addition, the stress acting on the insert acts more easily on the rod, and thus in turn on the coating event.

In a thirteenth embodiment, a water groove in the insert is arranged to lead lubricating water using a lubricating-water hose, which is glued to the water groove in the insert. By gluing the lubricating-water hoses onto the water groove, a simpler construction is achieved than in attaching the lubricating-water hoses using separate end flanges. The attachment made by gluing thus permits a simpler construction.

In the following, the invention is examined in detail with reference to the accompanying drawing showing the prior art and to the accompanying drawings showing some applications of the invention.

DESCRIPTION OF THE PREFERRED EMBODIMENTS

Figure 1:
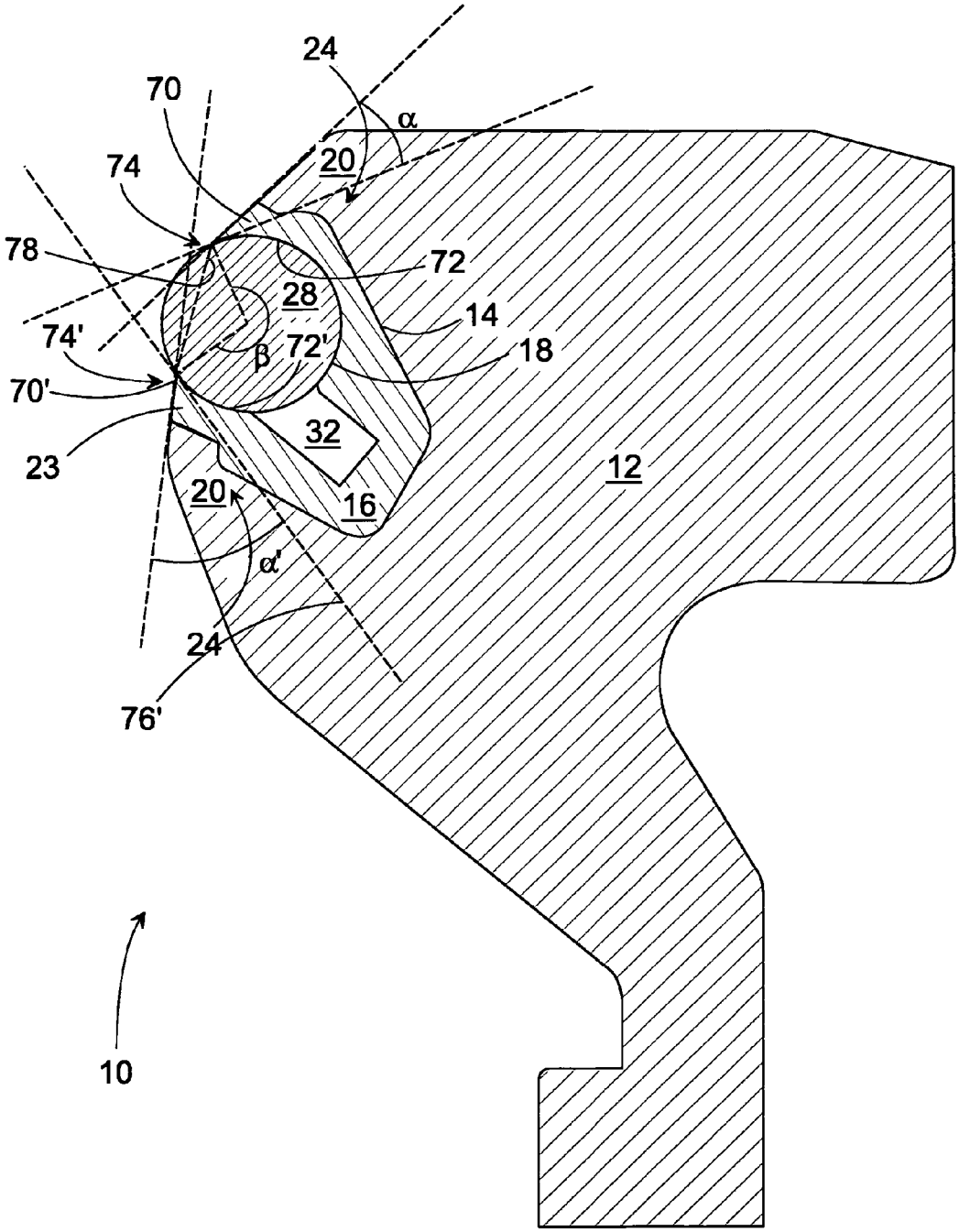
FIG. 1 shows one rod cradle according to the prior art.

FIG. 1 shows one rod cradle 10 according to the prior art. The rod cradle 10 includes a frame profile 12 equipped with an insert groove 14. An insert 16, equipped with a rod groove 18, and a rod 28 and locking elements 24 are fitted to the frame profile 12. The locking of the insert 16 to the frame profile 12 takes place using these locking elements. At the sides of the insert groove 14 in the frame profile 12 there are edges 20. At the sides of the rod groove 18 there are lips 22 corresponding to them. The lips 22 include a vertex 74, which is the extreme point of contact with the rod, i.e. the point after which the insert is not in contact with the rod. The lips 22 also include a cover surface 72, 72' which is in contact with the rod 28, when the rod 28 is in the rod groove 18. In addition, the lips 22 include a vertex surface 70, 70', which separates from the cover surface 72, 72' at the vertex 74, 74'. In the solution according to the prior art, the rod is first placed in the insert, which is placed after this in the insert groove in the frame profile. The locking that takes place using the locking elements can be ensured, for example, using a locking hose. In the solution according to the prior art, the frame profile 12 flexes when the insert 16, in which the rod 28 is installed, is placed in the insert groove 14.

In the rod cradle 10, according to the prior art, shown in FIG. 1, the insert 16 can be locked not only by the locking elements 24, but also by, for example, a locking hose. Locking that takes place using locking of this kind and a locking hose locks the insert in its groove and prevents it from jumping out, but the insert can nevertheless move in the longitudinal direction. In other words, in the prior art, the retaining force of the locking elements is based, as is known, on locking hoses, which are intended to press the insert into the insert groove, thus preventing the insert from jumping out of the insert groove. To some extent, they can also prevent the axial motion of the insert, but generally not entirely. Because the rod rotates continually around its axis, when the rod is in the rod groove a force develops between the rod and the insert, which tends to move the insert in the axial direction. If pressure is then increased in the locking hoses, friction will increase between the insert groove and the insert, thus preventing axial motion to some extent. On the other hand, using the locking hoses to increase pressure will also increase the contact between the insert and the groove rod, so that the axial force moving the insert relative to the rod will be greater than before the increase of pressure to the locking hose.

In the rod cradle according to the prior art shown in FIG. 1, there is a cover area on the side of the rod groove 18, between the vertices 74, 74', which is formed from the cover surfaces 72, 72', as well as from the water groove 32 between them. The cover area can also consist of a unified cover surface, or there can also be several grooves in the cover surface. The cover area covers the rod over the area of the cover angle $\beta$. In the solution according to the FIG. 1, the cover angle is about 260°. In turn, the angle $\alpha$ between the tangent 76 of the vertex surface 70 running through the vertex 74 and the tangent 80 of the cover surface 72 running through the same vertex 74 is about 20° while the angle $\alpha'$ between the tangent 76' of the vertex surface 70' and the tangent 80' of the cover surface 72' is about 45°. In addition, the tangent 76 of the first vertex surface 70 running through the first vertex 74 intersects the tangent 76' of the opposite vertex surface 70' running through the opposite vertex 74' on the opposite side of the rod groove 18 of the straight line 78 between the vertices 74, 74'. When the rod is installed in the rod cradle shown in FIG. 1, the rod is first placed in the insert and after that placed together with the insert in the frame profile. The rod cannot be installed in an insert that has been set in place, as the vertices of the lips of the insert would then break.

Figure 2:
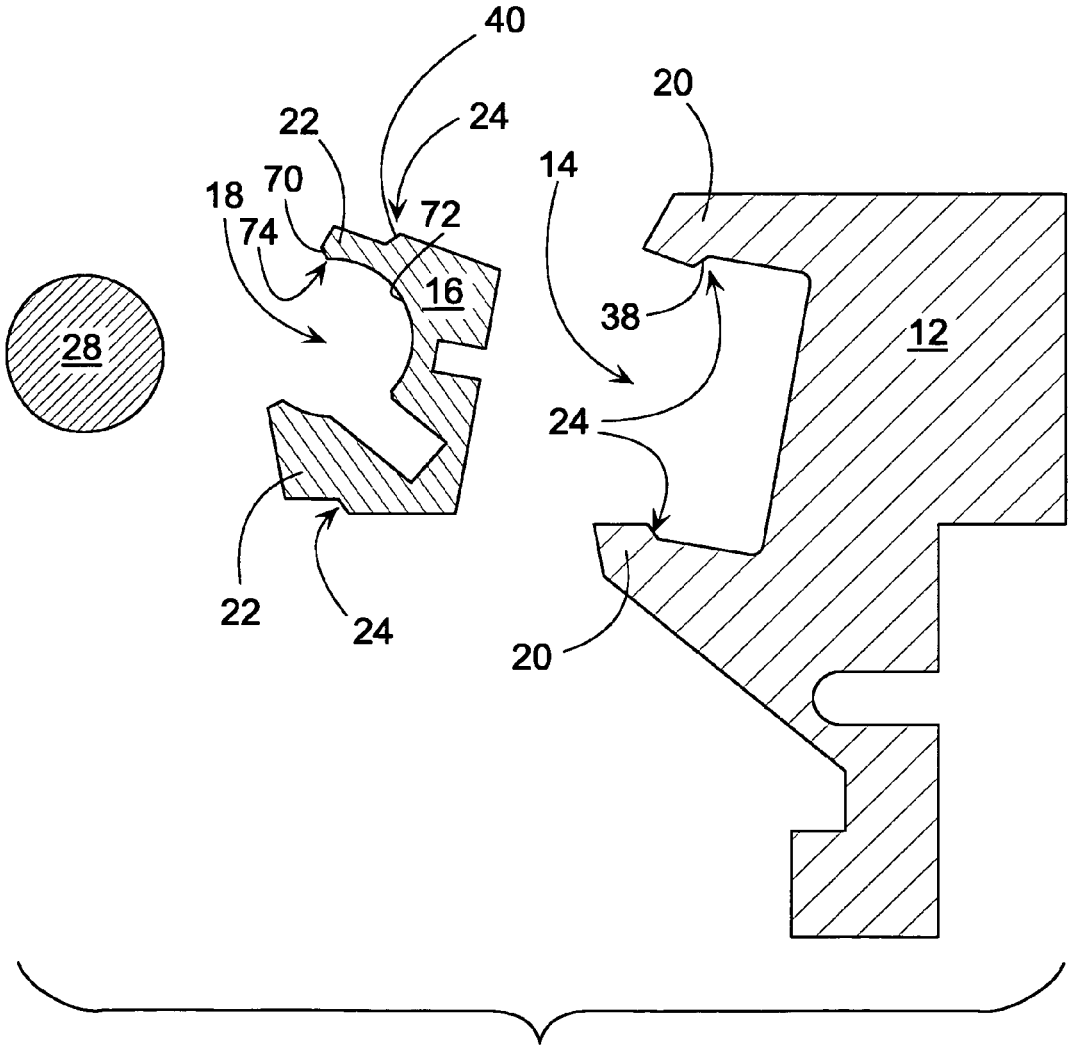
FIG. 2 shows the structural components of a rod cradle according to the invention, when the insert and rod are out of the grooves.
Figure 3:
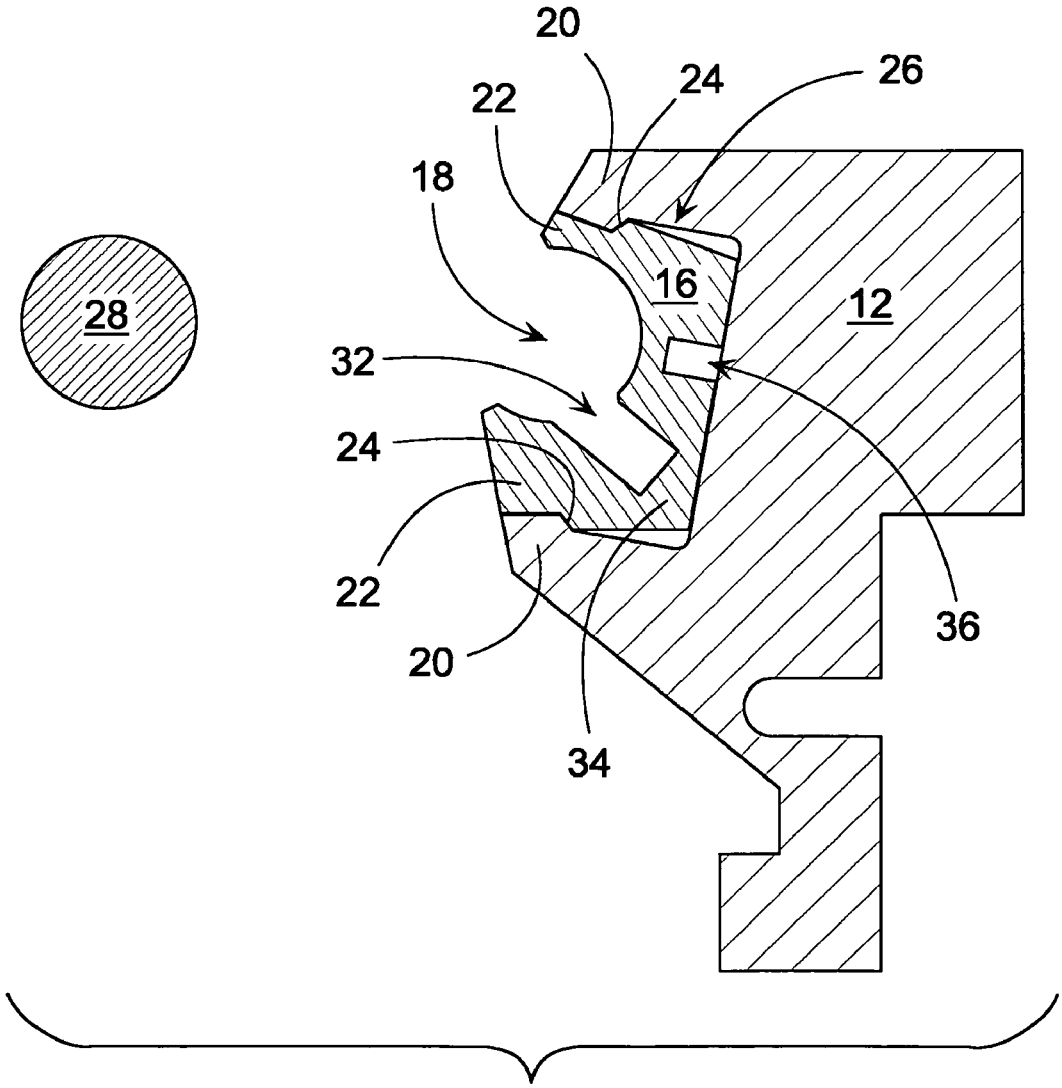
FIG. 3 shows the frame profile of a rod cradle according to the invention, in which the insert is installed in the insert groove.

FIG. 2 shows the main components of the rod cradle according to the invention, which are a frame profile 12 equipped with an insert groove 14, an insert 16, equipped with a rod groove 18, fitted to this, and a rod 28. The rod cradle also includes locking elements 24 for locking the insert 16 to the frame profile 12. There are opposing edges 20 at the sides of the insert groove 14 in the frame profile 12 and opposing lips 22 on the sides of the rod groove 18. In addition, the said locking elements 24 comprise a locking arrangement 26, as shown in FIG. 3, between the edges 20 of the insert groove 14 and the lips 22 of the insert 16. The locking arrangement 26 is arranged to permit the insert 16 to be set in place with the rod groove 18 empty and to lock each of the said lips 22 to each of the opposing edges 20, when the rod 28 is in the rod groove 18. In other words, when placing the rod 28 in the insert 16, which is in the insert groove 14, each said lip 22 is locked in the rod groove 18 to each opposing edge 20.

The lips 22 of the insert 16 of the rod cradle 10 shown in FIG. 2 include a vertex 74. The lips 22 also include a cover surface 72, which cover surface 72 is in contact with the rod 28 when the rod 28 is in the rod groove 18. In addition, the lips include a vertex surface 70, which separates from the cover surface 72 at the vertex 74.

FIG. 3 shows a rod cradle according to the invention, in which the insert 16 is in the insert groove 14, with the rod groove 18 empty. The locking arrangement 26, by means of which the insert 16 is fitted to the locking insert groove 14 in the frame profile 12, includes locking teeth 38 in the edges 20 of the frame profile 12, and locking detents 40 in the lips 22 of the insert 16. When using a rod with a diameter of 9-15 mm, the cross-sectional surface area of the insert groove is about 400 $mm^2$ (more usually 200-500 $mm^2$). The diameters of the rods used are in the range 9-25 mm.

In the rod cradle according to the invention, shown in FIG. 3, the insert 16 is installed in the insert groove 14. The locking elements 24 include a locking arrangement 26 between the lips 22 of the insert 16 and the edges 20 of the insert groove. As the locking arrangement is created without separate expensive and difficult locking components, such as locking hoses, a cheaper solution with more reliable operation is achieved. The essential feature of the locking arrangement 26 is that it creates, as it were, itself, when the insert 16 is placed in the insert groove. The insert groove and the insert 16 are dimensioned in such a way that the insert 16 can be installed in the insert groove when the insert groove is empty. The insert flexes at the neck 34 formed in the area at the bottom of the water groove 32. In other words, the neck 34 acts as a hinge.

In the insert 16 shown in FIG. 3, there is one additional groove 36, in order to achieve the selected flexibility. In other words, if additional flexibility is desired in the structure, at least one additional groove is made in it. The additional groove can be made in the external or the cover surface of the insert. The additional groove is preferably made in the external surface of the insert, as in that case a considerable increase in flexibility will be obtained from even a small additional groove. In addition, pressurized water or air can, if necessary, be fed to the additional groove or grooves, which will facilitate the removal of the insert from the insert groove. The insert flexes when being set in place, in such a way that the width of the insert without loading at the location of the locking detent is 9% (usually 5-15%) greater that the distance between the locking teeth in the inset groove.

Figure 4:
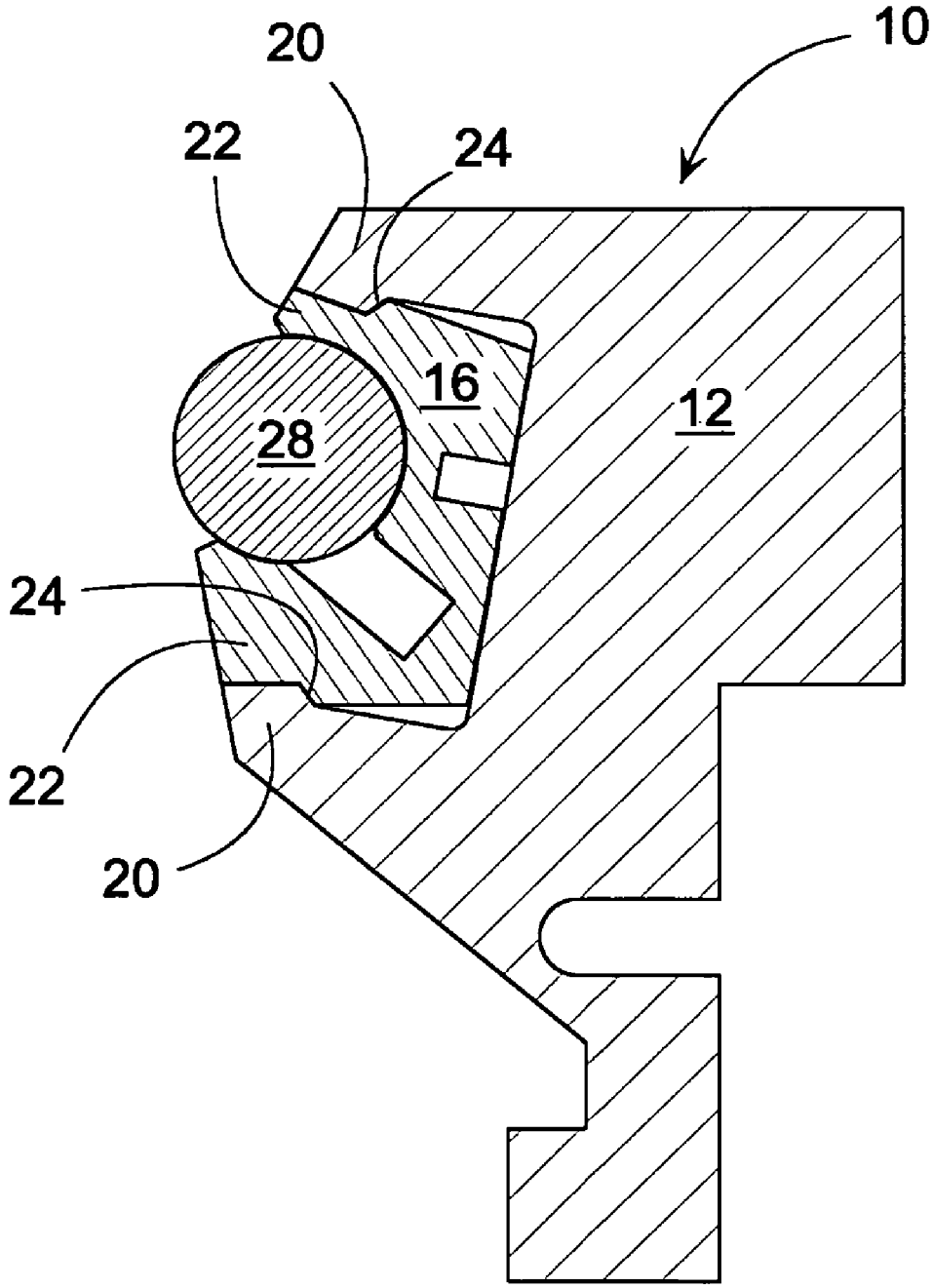
FIG. 4 shows a rod cradle according to the invention, in which the insert is installed in the insert groove and the rod in the rod groove.

In the rod cradle according to the invention shown in FIG. 4, the rod 28 is set in place in the rod groove 18 locking the insert 16 in the insert groove. The dimensioning and material of the insert are selected case-specifically, in such a way that placing the rod 28 in the rod groove 18 will not damage the rod, but a sufficient force is created between the insert and the rod to hold the rod in place. When the rod 28 is in the rod groove, the lip 22 locks onto the opposite edge 20. The insert flexes when the rod is installed and the distance between the lips increases by about 7% (normally 2-15%), when the widest part of the rod goes between the lips.

Figure 5:
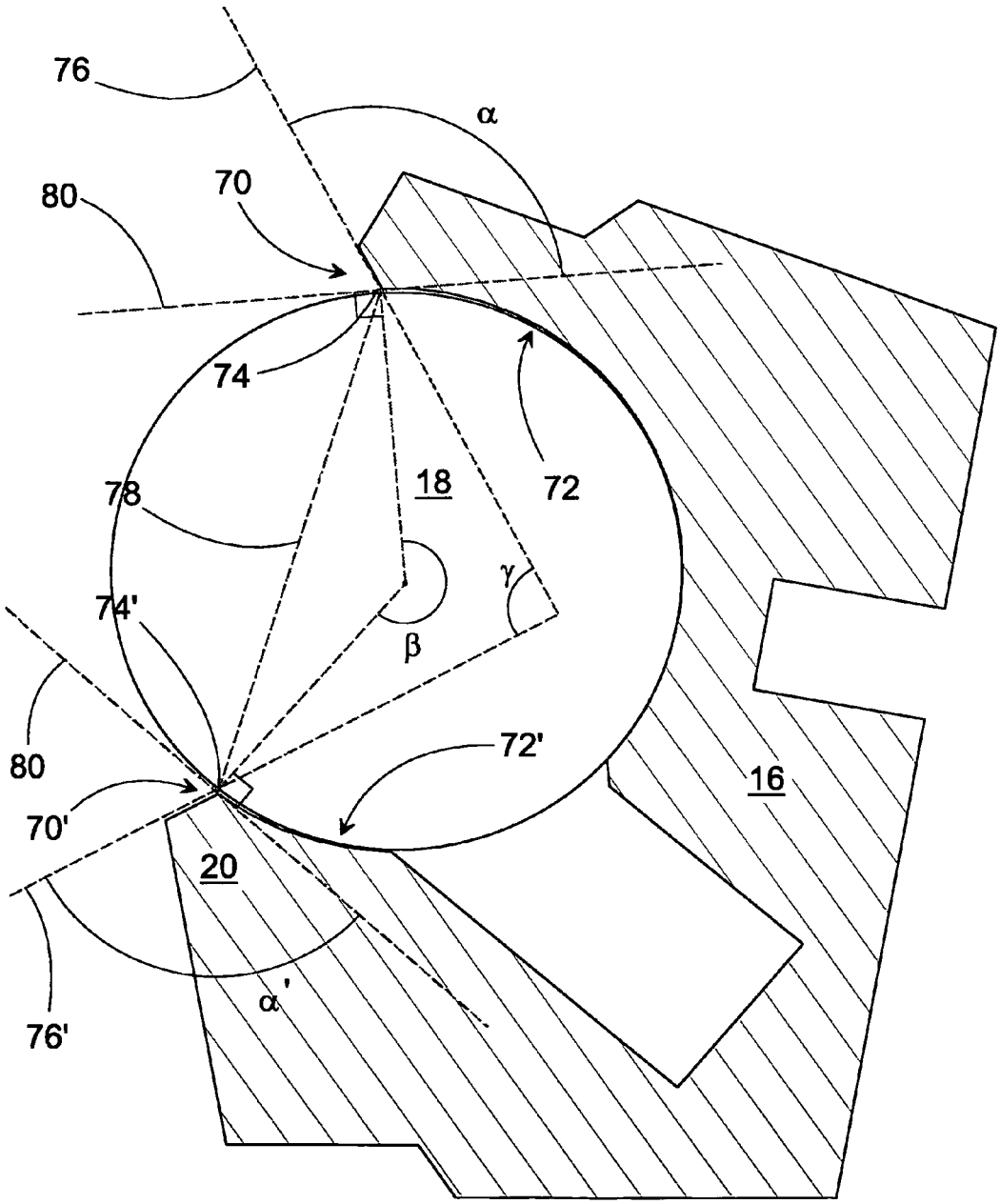
FIG. 5 shows an enlargement of one insert according to the invention.

FIG. 5 shows an enlargement of the insert according to the invention, which is used in a rod cradle containing a film, coating, or dam rod. The rod cradle includes a frame profile equipped with an insert groove and an insert 16 equipped with a rod groove 18, as well as a rod 28. There are edges on the sides of the insert groove in the frame profile and lips 22 corresponding to them on the sides of the rod groove 18 in the insert 16. The lips 22 of the insert 16 include a vertex 74, 74'. In addition, the lips include a cover surface 72, 72', which is in contact with the rod when the rod is in the rod groove. The lips also include a vertex surface 70, 70', which separates from the cover surfaces 72, 72' at the vertexes 74, 74'. The tangent 76 of the first vertex surface 70 running through the first vertex 74 intersects the tangent 76' of the opposite vertex surface 70', on the rod groove 18 side of the straight line 78 between the vertices 74, 74'. In addition, on the side of the rod groove 18 between the vertices 74, 74', there is a cover area, which is arranged to cover the rod with a cover angle β, which is 190°-250°, preferably 210°-230°, typically 220°. In other words, when the rod is in the groove, the share of the open segment is 110°-170°, preferably 130°-150°.

Figure 6:
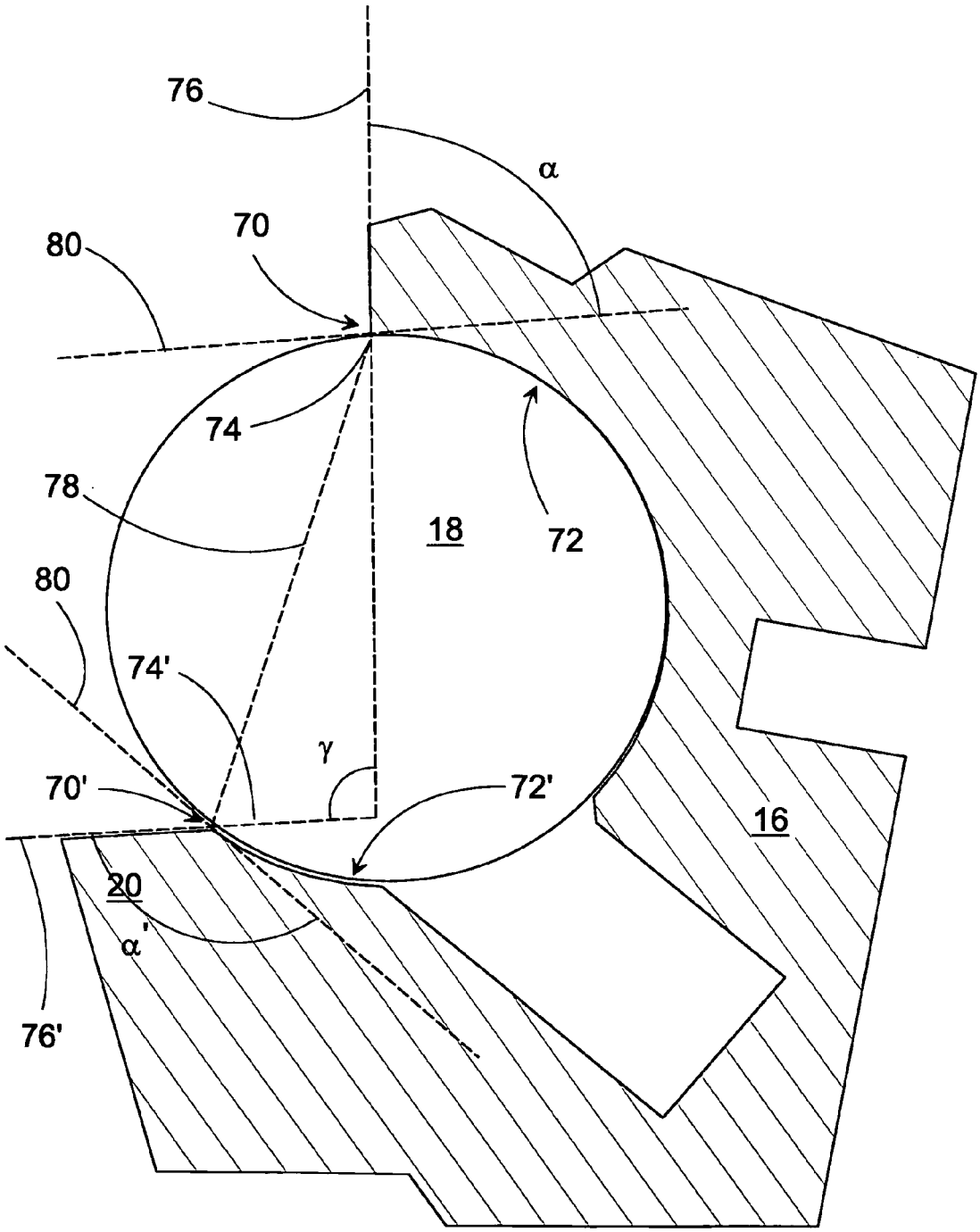
FIG. 6 shows an enlargement of a second insert according to the invention.

FIG. 6 shows an enlargement of a second insert according to the invention. The angle α between the tangent 76 of the vertex surface 70 running through the vertex 74 and the tangent 80 of the cover surface 72 running through the same vertex 74 is 60°-180°, preferably 95°-125°. When the angle α, is in the defined range, the rod can be placed into the rod groove without damaging the rod or the insert. If the angle α is less than 60°, it is highly probable that the sharp angle will be damaged when the rod is set in. On the other hand, depending on the material properties, the sharp angle may damage the rod. The angles are preferably less than 125°, but in special cases, and particularly when using round shapes, the angle α can be as much as 180°. In FIG. 6, the angle α is about 90° and the angle α' is about 135°. The angle α is formed on top of the lip of the insert.

In the insert shown in FIG. 6, the angle γ between the tangent 76 of the vertex 74 of the first vertex surface 70 and the tangent 76' of the vertex 74' of the second vertex surface 70' is 10°-170°, preferably 65°-115°. In FIG. 6, the angle γ in question is 90°. When the angle γ is in the range defined above, the opening between the vertex 70 narrows towards the rod groove. As the opening narrows in the direction in which the rod is placed in the opening, the rod will spread the opening. The angle γ is formed between the external sides of the rod groove of the tangents 76, 76'.

The method according to the invention is used in connection with rod cradles containing a film, coating, or dam rod, the numbers referring to FIGS. 2-4. An insert 16, equipped with a rod groove 18, and a rod are installed in the insert groove 14. The insert 16 and the rod 28 are locked in place by locking elements 24. First, the insert 16 is placed in the insert groove 14 in the frame profile 12, with the rod groove 18 empty. After this, the rod 28 is placed in the rod groove 18. In this case, the stiffness of frame profile 12, the rod 28, and the insert 16 are arranged to lock the insert 16 into the insert groove 14 and the rod 28 into the rod groove 18.

In FIG. 2, the rod 28, the insert 16, and the frame profile 12 are separate from each other. First, the insert is installed in the insert groove 14 in the frame profile 12. A point load of 10-500 N is used to set the insert 16 in the insert groove 14, with the rod groove 18 empty. Once the insert 16 has been set in the insert groove 14, the situation according to FIG. 3 is achieved. After this, the rod 28 is set into the rod groove 18 in the insert 16 installed in the frame profile 12. A point load of 50-1000 N is used to set the rod 28 in the rod groove 18. Once the rod 28 has been set in the rod groove 18, the situation according to FIG. 4 is achieved. The insert 16 and the rod 28 are then locked in place in connection with the frame profile 12.

The rod cradle shown in FIGS. 2 and 4 is intended for a film, coating, or dam rod. In FIG. 4, the insert and the rod are in place, but in FIG. 2 the insert and the rod are out of their grooves. The rod cradle 10 is equipped with an insert 16, i.e. the insert 16 is located in the insert groove 14 in the frame profile. In the insert 16, there is a rod groove 18 for the rod 28. The rod cradle 10 also includes locking elements 24, by means of which the insert 16 is locked into the frame profile 12 during operations. In the insert 16, there is a water groove 32, which is used to spread lubricating water as desired over the length of the rod. One embodiment according to the invention includes an insert axial-motion prevention element, which extends radially to the longitudinal line of the insert. The longitudinal line of the insert is cross-sectional area of the insert, which is clearly seen in FIGS. 4 and 2. The axial-motion prevention element according to the invention can be located very freely, as long as it is partly on the longitudinal line of the insert. The axial-motion prevention element can be a screw, which runs through the frame profile to the insert, thus preventing the axial motion of the insert. Preferably, the axial-motion prevention element is shaped in, or at the end of the insert groove. The shape in question prevents the insert from moving in an axial direction relative to the frame profile. The use of such shaping achieves an application, in which tools are not needed to detach the insert from the axial-motion prevention element.

The shaping of a frame profile equipped with a locking hose is similar in as much as in it the insert has correspondingly a longitudinal line. In a version with a locking hose too, it is possible to lock the insert in the axial direction using an axial-motion prevention element, which extends radially to the longitudinal line of the insert.

Figure 7:
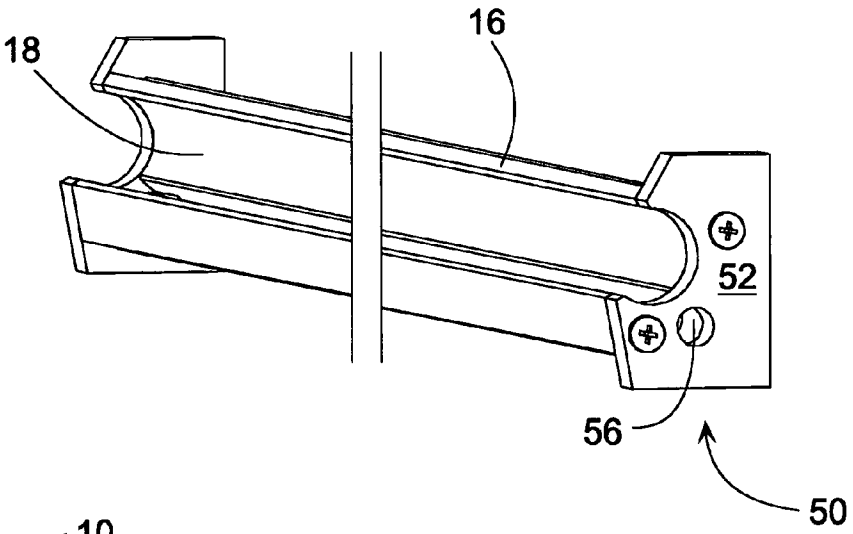
FIG. 7 shows the insert, in which there are end flanges, of a rod cradle according to the invention.

The rod cradle and both the frame profile and the insert belonging to it have a first end and a second end. The axial-motion prevention element is in connection with at least one end of the rod cradle. Here, the term the end of the rod cradle refers to the end of the frame profile or of the insert. The axial-motion prevention element is indeed attached to the end of the frame profile or of the insert. In FIG. 7, the elongated insert is shown partly, i.e. the part in the middle of it has been omitted. The location of the omitted part is shown by two broken lines. The insert is attached to the end flange 52. The end flange 52 attached to the insert 16 acts as the axial-motion prevention element 50. In addition, the end flange can be used to attach the lubricating-water hose to the insert. When attaching the lubricating-water hose to the insert with the aid of the end flange, the attachment of the lubricating-water hose to the structure is made very durable, as the end flange can be attached by screws. The end flange can also be attached by gluing, but a mechanical attachment implemented by screws will be more certain in the application in question.

Which end the prevention element is attached to depends on the direction of the thread in the rod. If the rod has no thread, a prevention element can be attached to both ends of the rod cradle. If the rod is not threaded, a prevention element can be used at both ends of the rod cradle. The insert 16 shown has an end flange 52 acting as a prevention element 50 at both ends. Such a construction is highly suitable for use with a smooth rod, which can move in either direction. This is always a small amount of inaccuracy in alignments and manufacture, which can cause movement, even in a smooth rod.

In FIG. 7, the end flange acts as an insert axial-motion prevention element, so that in the case according to the figure there is an insert axial-motion prevention element at both ends of the rod cradle. In the embodiment in question, the operation of the end flanges combines supporting the water groove and being an axial-motion prevention element. The embodiment in question is preferably used when the forces causing axial movement are small. Small forces of this kind typically appear on smooth rods. The construction in question with end flanges can be used even with grooved rods, but in that case care must be taken in dimensioning.

Figure 8:
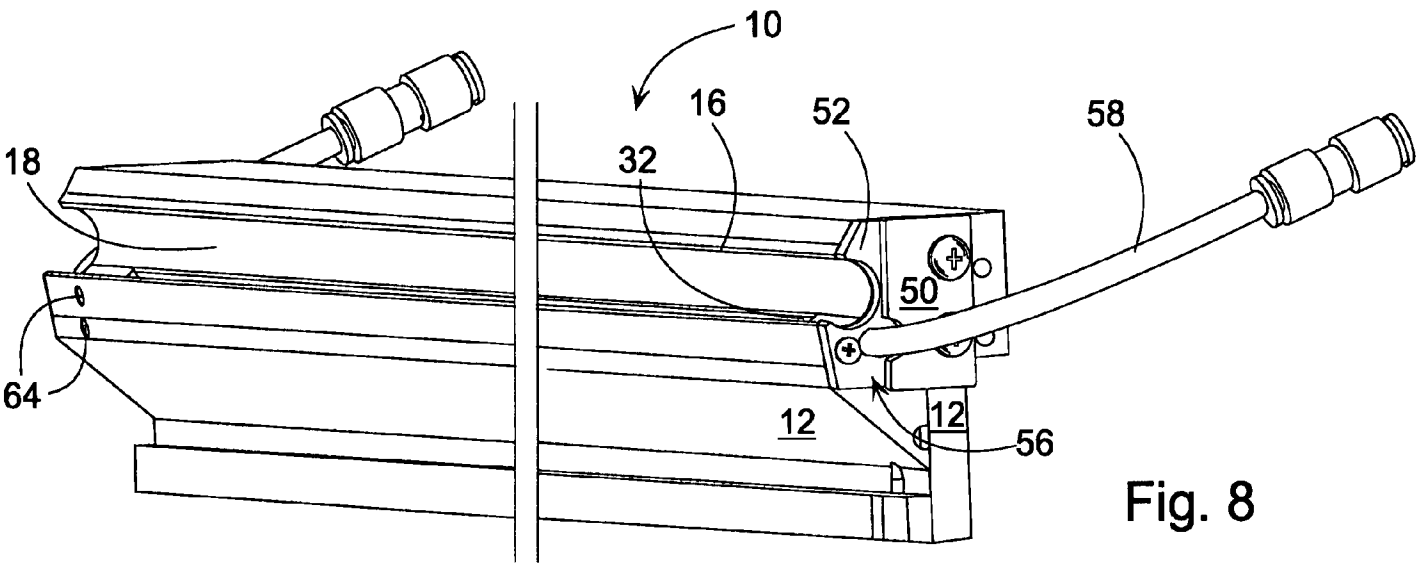
FIG. 8 shows a rod cradle according to the invention, in which there is an axial-motion prevention element, and end flanges in the insert.

FIG. 8 shows a rod cradle 10 according to the invention, in which there is an axial-motion prevention element 50 attached to the frame profile 12, and end flanges 52 are attached to the insert 16. In FIG. 8, the elongated insert is shown in part, i.e. the part in the middle of it has been omitted. The omitted part is shown by two broken lines. In this embodiment, the main task of the end flanges 52 is to support the ends of the lubricating-water groove 32. There is a hole 56 in the end flange 52 for a lubricating-water hose 58. The lubricating water is fed to lubricating-water groove by lubricating-water hoses. The end flanges 52 as such prevent axial motion in the insert 16, but it is difficult to attach them to the insert sufficiently firmly. When the grooved rod rotates, even very large forces can be induced in the insert, so that the attachment between the end flanges and the insert can be placed under really great strain. An actual axial-motion prevention element 50, which is attached to the frame profile 12, is preferably used with the end flanges 52. The axial-motion prevention elements are preferably attached to the frame profile, as the attachment of the prevention elements to the frame profile can be made with considerably larger screws than the attachment of the end flanges to the insert. The end flanges can be attached to the insert, for example, using two 30-mm long and 3-mm thick screws. In turn, the actual axial-motion prevention element can be attached to the frame profile using larger screws. The attachment is preferably made using screws with a length of 40-70 mm and a thickness of 3-6 mm. The attachment can be made, for example, using two 50-mm long and 5-mm thick screws. The axial-motion prevention element attached to the frame profile is preferably of metal, as small and durable prevention elements can be manufactured from metal.

Figure 9:
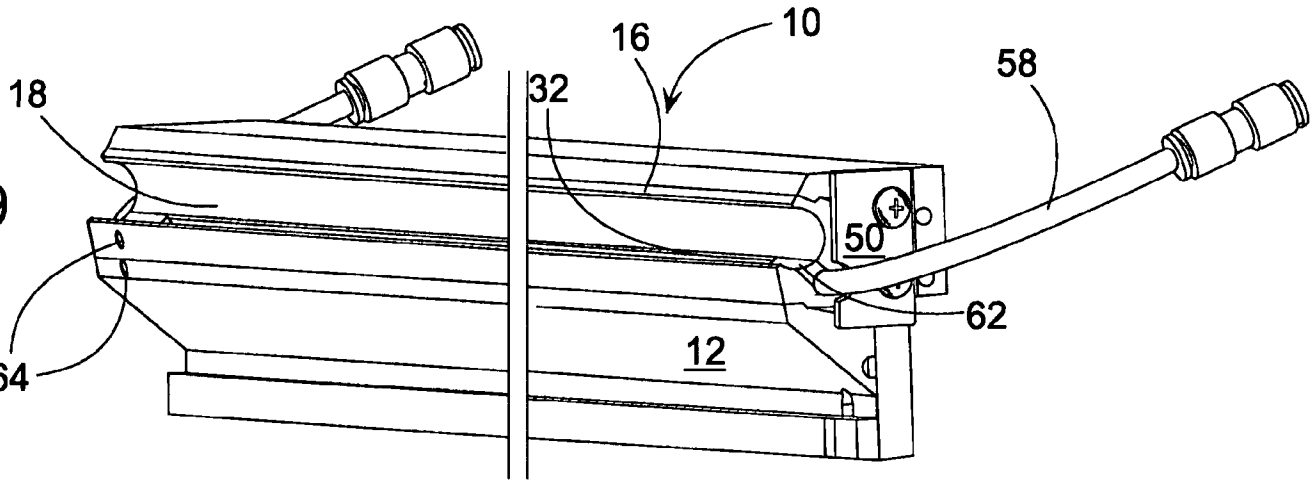
FIG. 9 shows a rod cradle according to the invention, in which there is an insert axial-motion prevention element, and lubricating-water hoses glued to the insert.

FIG. 9 shows a rod cradle 10 according to the invention, in which there is an insert 16 axial-motion prevention element 50 and the lubricating-water hoses 58 are glued to the insert 16. The adhesive 62, which is used to attach the lubricating-water hoses 58, blocks the water groove 32, so that the water travels in a controlled manner from the water groove to the pipe. The elongated insert 16 is shown partly, i.e. the part in the middle of it is omitted. The omitted part is shown by two broken lines. When using a prevention element 50 attached to the frame profile 12, the lubricating-water hoses are attached by adhesive, because it is then possible to reduce the number of components. The water groove 32 in the insert 16 is arranged to lead the lubricating water using a lubricating-water hose 58, which is glued to the water groove 32 in the insert 16. When the lubricating-water hoses are attached by gluing, a simpler construction is achieved than when attaching the lubricating-water hoses by end flanges. The separate end flanges and prevention elements lead to an excessive number of components. Thus, the use of end flanges is typically only worthwhile if they act as both prevention elements and as means for attaching the lubricating-water hoses. The lubricating-water hose 58 is arranged to be glued over a distance of 20-60 mm, preferably 30-50 mm into the water groove 32. When gluing the lubricating-water hose to the water groove, its permanence is a central factor—if the gluing is made over a distance of less than 20 mm, the lubricating-water hose will not necessarily remain attached to the groove. By using gluing that is at least 30-mm long, the permanence will be further ensured. On the other hand, gluing should take place over a distance of less than 60 mm, as otherwise a lack of lubricating water will begin to affect the operation of the rod. Using a gluing length of at most 50 mm will ensure the spreading of the lubricating water sufficiently close to the end of the rod.

The lubricating-water hose can be attached by gluing, even in applications in which an axial-motion prevention element according to the invention is not used. A lubricating-water hose that is attached by gluing is also suitable for use in a rod cradle operating with a locking hose. By gluing the lubricating-water hose, the number of components forming part of the construction can be reduced and the construction simplified, as a separate end flange will not then be required for attaching the lubricating-water hose.

Figure 10:
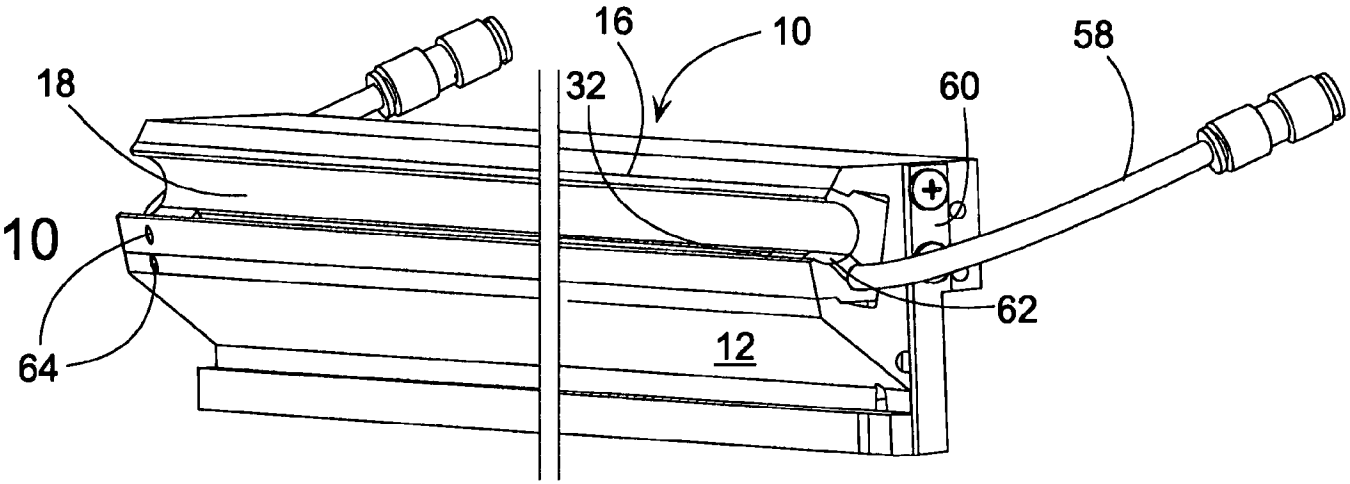
FIG. 10 shows a rod cradle according to the invention, at the left-hand end of which there is an insert axial-motion prevention element and at the right-hand end a frame-profile stiffener.

FIG. 10 shows a rod cradle 10 according to the invention, at the left-hand end of which there is an insert 16 axial-motion prevention element (not visible) and at the right-hand end a frame-profile 12 support flange 60. The rod cradle 10 in question is thus a mirror image of the rod-cradle 10 shown in FIG. 9. A prevention element is not required at both ends, when a threaded rod is used, as the threaded rod pushes the insert in a direction that tends to prevent motion. Seen from the prevention element, at the other end of the rod cradle and thus the frame profile, there is a support flange, which stiffens the frame profile. The elongated insert is shown in part, i.e. the part in the middle of it is omitted. The location of the omitted part is shown by two broken lines.

The rod cradles 10 shown in FIGS. 8 and 9 include a frame profile 12 with an insert groove 14, which in turn includes an insert 16 with a rod groove 18. FIG. 4 shows a cross-section of the construction in question, while the components of the construction are shown separated from each other in FIG. 2. In FIG. 2, there are edges 20 in the frame profile 12 on the sides of the insert groove 14. In the insert 16, there is in turn a rod groove 18. On the sides of the rod groove 18 there are lips 22 corresponding to the edges 20 of the frame profile 12. The locking elements 24 comprise a locking arrangement between the edges 20 of the insert groove 14 and the lips 22 of the insert. The locking arrangement is arranged to permit the insert to be set in place with the rod groove 18 empty, and to lock each said lip 22 to the opposing edge 20 when the rod 28 is in the rod groove 18. Locking the insert to the insert groove in the frame profile thus takes place without a locking hose. It is highly preferable to use the axial-motion prevention element according to the element with precisely this construction, as the dimensioning of the locking elements will prevent the insert from jumping out of the insert groove, but will not necessarily take into account the axial motion of the insert.

In FIG. 2, the locking arrangement includes a locking tooth 38 at the edge of the insert groove 14 and a corresponding locking detent 40 in the adjacent lip 22. There is preferably a locking detent 40 on both sides of the insert 16, while a straight line drawn between the locking detents 40 runs through the intersection surface of the rod 28, thus effectively locking the insert to the insert groove and the rod to the rod groove.

The cross-section of the insert used can be shaped in such a way that it will fit the insert groove either way round. There are preferably alignment marks 64 in the insert and the frame profile, which can be seen in FIGS. 8-10. The alignment marks are used to ensure that the insert is installed in the insert groove the right way round and at the correct location.

The prevention element according to the invention permits the creation of an entirely new type of totality, in which a locking hose is not needed. Such an embodiment, implemented without a locking hose, permits construction of much greater operational reliability, as a certain degree of uncertainty is always associated with the use of locking hoses. For example, a locking hose can fracture, which will cause a dangerous situation. In addition, a locking hose makes the frame structure more difficult to manufacture. Further, the groove made in the frame profile for the locking hose may increase the flexibility of the frame profile unnecessarily.

The invention claimed is:

1. A rod cradle for a film, coating, or dam rod, comprising:

a frame profile having portions forming a first edge and a second edge opposed to the first edge and an insert groove formed between the first edge and the second edge, the insert groove extending into the frame profile and defining a first side and a second side of the insert groove;

a rod, defining a circumference;

an insert having portions forming a first lip, and a second lip opposed to the first lip and a rod groove holding the rod, the rod groove formed between the first lip and the second lip, the first lip having a first cover surface in contact with the rod, the first lip having a first vertex surface which extends away from a first vertex which terminates the first cover surface in contact with the rod, and the second lip having a second cover surface in contact with the rod, the second lip having a second vertex surface which extends away from a second vertex which terminates the second cover surface in contact with the rod;

wherein the frame profile has locking elements located between the edges of the insert groove, and the lips of the insert;

wherein said locking elements are arranged to permit the insert to be set in place with the rod groove empty of the rod, and to lock said first lip to the first edge, and the second lip to the second edge, when the rod is in the rod groove; and wherein between the first vertex and the second vertex there is a cover area, which is arranged to cover the rod over an angle of 190°-250° with respect to the circumference defined by the rod.

2. The rod cradle of claim 1, wherein a first angle is defined between a tangent of the first vertex surface which runs through the first vertex and a tangent of the first cover surface which runs through the first vertex, the first angle being 60°-180°, and wherein a second angle is defined between a tangent of the second vertex surface which runs through the second vertex and a tangent of the second cover surface which runs through the second vertex, the second angle being 60°-180°.

3. The rod cradle of claim 1, wherein a first angle is defined between a tangent of the first vertex surface which runs through the first vertex and a tangent of the first cover surface which runs through the first vertex, the first angle being 95°-125°, and wherein a second angle is defined between a tangent of the second vertex surface which runs through the second vertex and a tangent of the second cover surface which runs through the second vertex, the second angle being 95°-125°.

4. The rod cradle of claim 1, wherein a vertex line is defined between the first vertex and the second vertex; and a tangent of the first vertex surface running through the first vertex intersects a tangent of the second vertex surface running through the second vertex, on a side of the vertex line on which the rod groove also lies.

5. The rod cradle of claim 1, wherein portions of the insert form a water groove having a bottom area which forms a neck which is arranged to act as a hinge, so the insert can bend about the hinge and be placed in the insert groove when the rod is not present in the rod groove.

6. The rod cradle of claim 1, wherein the insert has portions forming at least one additional groove, in order to achieve a selected flexibility of the insert.

7. The rod cradle of claim 1, wherein the locking elements include a locking tooth in the first or second edge of the insert groove and a locking detent corresponding to it on the adjacent first or second lip.

8. The rod cradle of claim 1, wherein the frame profile is of polyethylene.

9. The rod cradle of claim 1, wherein the frame profile is of polyurethane.

10. The rod cradle of claim 1, wherein the insert is of polyethylene, which contains additives that improve wear resistance or reduce friction.

11. The rod cradle of claim 1, wherein the rod cradle includes an insert axial-motion prevention element, which extends radially to a longitudinal line defined by the insert.

12. The rod cradle of claim 11, wherein the axial-motion prevention element is attached to the frame profile.

13. The rod cradle of claim 11, wherein between the insert and the axial-motion prevention element there is an end flange.

14. The rod cradle of claim 1, wherein the insert has portions defining a water groove, to which water groove is glued a lubricating-water hose through which lubricating water is arranged to be led.

15. An insert assembly for use in a rod cradle having a frame profile having portions forming a first edge and a second edge opposed to the first edge and an insert groove formed between the first edge and the second edge, the insert assembly comprising:

a rod;

an insert having portions forming a first lip and a second lip opposed to the first lip, and a rod groove holding the rod, the rod groove formed between the first lip and the second lip, the first lip having a first cover surface in contact with the rod, the first lip having a first vertex surface which extends away from a first vertex which terminates the first cover surface in contact with the rod, and the second lip having a second cover surface in contact with the rod, the second lip having a second vertex surface which extends away from a second vertex which terminates the second cover surface in contact with the rod;

wherein a vertex line is defined between the first vertex and the second vertex; and a tangent of the first vertex surface running through the first vertex intersects a tangent of the second vertex surface running through the second vertex, on a side of the vertex line on which the rod groove also lies;

wherein between the first vertex and the second vertex there is a cover area, which is arranged to cover the rod over an angle of 190°-250° with respect to a circumference defined by the rod;

wherein the first lip has a first locking profile opposite the first cover surface which is engageable with a locking element on the first edge of the frame profile, and wherein the second lip has a second locking profile opposite the second cover surface which is engageable with a second locking element on the second edge of the frame profile; and wherein said first locking profile and said second locking profile are arranged to permit the insert to be set in place in the insert groove of the frame with the rod groove empty of the rod, and to lock said first lip to the first edge, and the second lip to the second edge, when the rod is in the rod groove.

16. The insert assembly of claim 15, wherein the cover area between the first vertex and the second vertex is arranged to cover the rod over an angle of 210°-230° with respect to the circumference defined by the rod.

17. A method for setting a film, coating, or dam rod into a rod cradle, comprising the steps of:

setting into an insert groove of a frame an insert having a rod groove which is empty of a rod, the insert having portions forming a first lip, and a second lip opposed to the first lip, wherein the rod groove is formed between the first lip and the second lip, the first lip having a first cover surface for contact with the rod, the first lip having a first vertex surface which extends away from a first vertex which terminates the first cover surface, and the second lip having a second cover surface for contact with the rod, the second lip having a second vertex surface which extends away from a second vertex which terminates the second cover surface, wherein the insert groove of the frame profile has portions forming a first edge and a second edge opposed to the first edge, the insert groove formed between the first edge and the second edge, the insert groove extending into the frame profile and defining a first side and a second side of the insert groove wherein there are locking elements between the insert and the frame profile, followed by;

installing a rod into the rod groove of the insert to lock said first lip to the first edge, and the second lip to the second edge, wherein the frame profile has a stiffness and the rod has a stiffness such that the rod in the insert locks the insert in the insert groove and the rod in the rod groove; and wherein between the first vertex and the second vertex there is a cover area, which covers the rod over an angle of 190°-250° with respect to a circumference defined by the rod.

18. The method of claim 17, wherein a point load of 10-500 N is used to install the insert, when the rod groove is empty, in the insert groove in the frame profile.

19. The method of claim 17, wherein a point load of 50-1000 N is used to install the rod in the rod groove when the insert is in the insert groove.

* * * * *